US008188926B2

(12) United States Patent
Ganwani et al.

(10) Patent No.: US 8,188,926 B2
(45) Date of Patent: May 29, 2012

(54) FOLDED ANTENNA STRUCTURES FOR PORTABLE DEVICES

(75) Inventors: Nisha Ganwani, Austin, TX (US); Jonathan D. Pearce, London (GB); Greg Allan Hodgson, Austin, TX (US); Aaron Blank, Elgin, TX (US)

(73) Assignee: Silicon Laboratories, Inc., Austin, TX (US)

( * ) Notice: Subject to any disclaimer, the term of this patent is extended or adjusted under 35 U.S.C. 154(b) by 666 days.

(21) Appl. No.: 12/317,031

(22) Filed: Dec. 18, 2008

(65) Prior Publication Data

US 2010/0109970 A1 May 6, 2010

Related U.S. Application Data

(60) Provisional application No. 61/198,010, filed on Oct. 31, 2008.

(51) Int. Cl.
*H01Q 1/38* (2006.01)

(52) U.S. Cl. ..... 343/700 MS; 343/702; 343/895

(58) Field of Classification Search ..... 343/700 MS, 343/702, 895, 713
See application file for complete search history.

(56) References Cited

U.S. PATENT DOCUMENTS

| | | | | |
|---|---|---|---|---|
| 5,337,061 | A | 8/1994 | Pye et al. | 343/702 |
| 5,508,709 | A | 4/1996 | Krenz et al. | 343/702 |
| 5,557,293 | A | 9/1996 | McCoy et al. | 343/867 |
| 6,008,774 | A | 12/1999 | Wu | 343/828 |
| 6,054,955 | A | 4/2000 | Schlegel, Jr. et al. | 343/702 |
| 6,124,831 | A | 9/2000 | Rutkowski et al. | 343/700 |
| 6,300,910 | B1 | 10/2001 | Kim | 343/702 |
| 6,674,405 | B2 | 1/2004 | Wang | 343/700 |
| 6,794,727 | B2 * | 9/2004 | Leduc et al. | 257/531 |
| 7,109,927 | B2 | 9/2006 | Gilbert et al. | 343/700 |
| 7,271,772 | B2 | 9/2007 | Qi et al. | 343/702 |
| 7,408,512 | B1 | 8/2008 | Rodenbeck et al. | 343/700 |
| 7,528,779 | B2 | 5/2009 | Stutzke | 343/700 |
| 7,554,490 | B2 | 6/2009 | Baliarda et al. | 343/700 |
| 7,598,921 | B2 | 10/2009 | Ge et al. | 343/806 |
| 2007/0159339 | A1 * | 7/2007 | Matsuura et al. | 340/572.8 |

* cited by examiner

*Primary Examiner* — Dieu H Duong

(74) *Attorney, Agent, or Firm* — O'Keefe, Egan, Peterman & Enders, LLP

(57) ABSTRACT

Methods and systems are disclosed for folded antenna structures that allow for receive and/or transmit antennas to be used for portable or other devices. The folded antennas described herein can be configured, for example, to fit the design constraints and considerations for portable devices. The folded antenna structures can be implemented using relatively flat flexible printed circuits (e.g., flex circuits) and can be placed in available spaces within the portable device, such as above or behind a battery, while still providing good performance characteristics. Still further, the folded antenna structures can be implemented on a printed circuit board and/or as part of plastic materials and pieces included as part of a portable device.

20 Claims, 6 Drawing Sheets

FOLDED ANTENNA STRUCTURES FOR PORTABLE DEVICES

RELATED APPLICATIONS

This application claims priority to the following co-pending provisional application: Provisional Application Ser. No. 61/198,010, filed on Oct. 31, 2008, and entitled "FOLDED ANTENNA STRUCTURES FOR PORTABLE DEVICES," which is hereby incorporated by reference in its entirety.

TECHNICAL FIELD OF THE INVENTION

This invention relates to radio frequency communications and, more particularly, to radio frequency receive and transmit operations in portable devices.

BACKGROUND

Portable devices exist that provide radio frequency (RF) receiver functionality and RF transmitter functionality. In addition, prior systems have used transmit antennas and receive antennas. For example, some portable devices have an FM transmitter and an FM receiver, as part of the same device. Many portable devices, however, have significant restrictions in the space available for antenna structures. These space constraints make it difficult to provide an antenna of appropriate size for transmission and reception of RF signals, particularly in the FM audio broadcast frequency spectrum (e.g., about 76 to 108 MHz).

SUMMARY OF THE INVENTION

Systems and methods are disclosed for folded antenna structures that allow for receive and/or transmit antennas to be used for portable or other devices. The folded antennas described herein can be configured, for example, to fit the design constraints and considerations for portable devices. In one embodiment, the folded antenna structures disclosed herein can be implemented using relatively flat flexible printed circuits (e.g., flex circuits) and can be placed in available spaces within the portable device, such as above or behind a battery, while still providing good performance characteristics. Still further, the folded antenna structures could be implemented on a printed circuit board and/or as part of plastic materials and pieces included as part of a portable device. Other features and variations could also be implemented, as desired, and related systems and methods can be utilized, as well.

DESCRIPTION OF THE DRAWINGS

It is noted that the appended drawings illustrate only example embodiments of the invention and are, therefore, not to be considered limiting of its scope, for the invention may admit to other equally effective embodiments.

DETAILED DESCRIPTION OF THE INVENTION

Systems and methods are disclosed for folded antenna structures that allow for effective receive and transmit antennas to be placed in spaces within portable devices.

In telecommunications, frequency modulation (FM) conveys information over a carrier wave by varying its frequency. As indicated above, the carrier wave frequencies for FM audio broadcasts are in the 100 MHz range and their corresponding wavelength is around three meters. Effective antennas for an RF frequency is traditionally a half wavelength dimension, which in the case of FM audio broadcasts amounts to a length of approximately 1.5 meters.

FM tuners are installed in many consumer electronic products to provide the capability to receive FM broadcast stations of a city or geographic region. These electronic products include cell phones, GPS (Global Positioning System) receivers, digital media players and other devices that are dimensionally small compared to FM half wavelength size. As such, these devices traditionally use external headphone wiring as the antenna to receive the FM energy in the FM audio broadcasts. As the consumer markets for these electronic devices are pushing towards even smaller dimensions and moving away from the use of external antenna connections, the industry is starting to see a trend towards embedded FM antennas, which are much smaller than the half wavelength size used in traditional solutions.

This folded antenna embodiments described herein provide new and advantageous embedded antennas that can be used to receive FM audio broadcasts and that can be built on the PCBs (printed circuit boards) of the consumer products discussed above and/or built on thinner flex circuits and then placed within these electronics products. These folded antennas can be configured to be a fraction of the FM wavelength while still providing superior FM reception. The folded antenna structures will now be described in more detail with respect to the drawings along with a discussion of how these folded antennas provide better performance than other embedded antennas having the same dimensions.

Figure 1A:
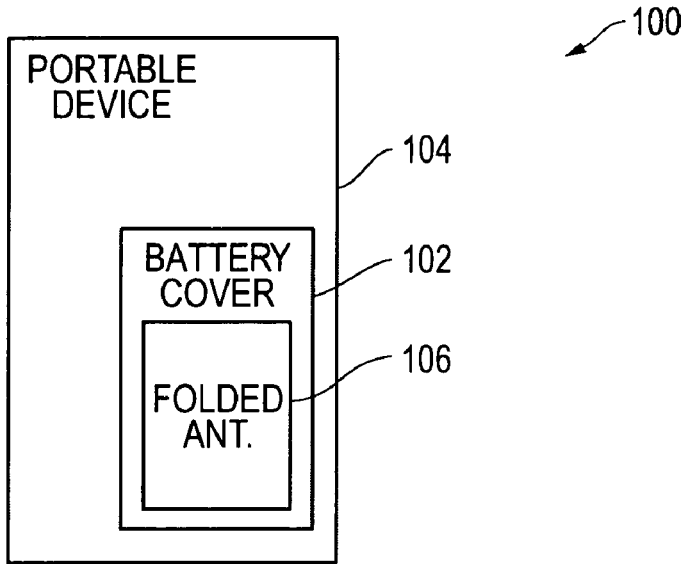
FIG. 1A is a block diagram for an embodiment of a portable device having an internal folded antenna structure.
Figure 1B:
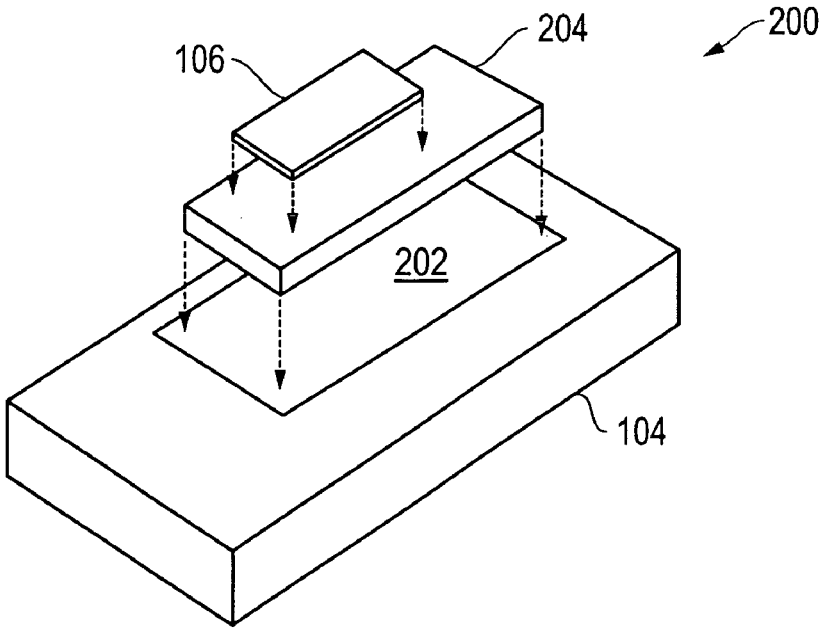
FIG. 1B is a perspective drawing of an assembly including a folded antenna.

FIGS. 1A and 1B provide an example small device environment with respect to which the folded antenna structures described herein could be utilized.

FIG. 1A is a block diagram for an embodiment 100 of a portable electronic device 104 having an internal folded antenna 106 that can be placed above or below a battery. For example, the internal folded antenna 106 can be placed on the inside of a battery cover 102 that goes over the battery for the portable device 104. The folded antenna 106 could also be placed in other locations, if desired.

FIG. 1B is a perspective drawing of an assembly 200 including a folded antenna 106 that is placed on top of the battery 204 once it is inserted into a space 202 within the portable device 104. As indicated above, the folded antenna 106 can be coupled to the inside of a battery cover 102 that would be placed over the battery 204. It is noted that the folded antenna 106 could also be placed within the space 202 prior to the placement of the battery 204, if desired. Further, the folded antenna 106 could be placed in other locations within or on the portable device 104, if desired.

FIGS. 2-6 provide different example embodiments for the folded antenna structures. As shown therein, the folded antenna structures can include foldings having one, two or more different directions to improve reception. Further, additional antenna structures could also be included, such as a loop antenna surrounding the folded antenna structure. It is further noted that the folded antennas described herein can be manufactured as part of a printed circuit board (PCB), flex circuit or some other support surface, as desired, with the antenna feed circuitry and the antenna conductor lines formed thereon. For example, antenna conductor lines can be screen printed on a PCB to form the desired folded antenna structures.

Figure 2:
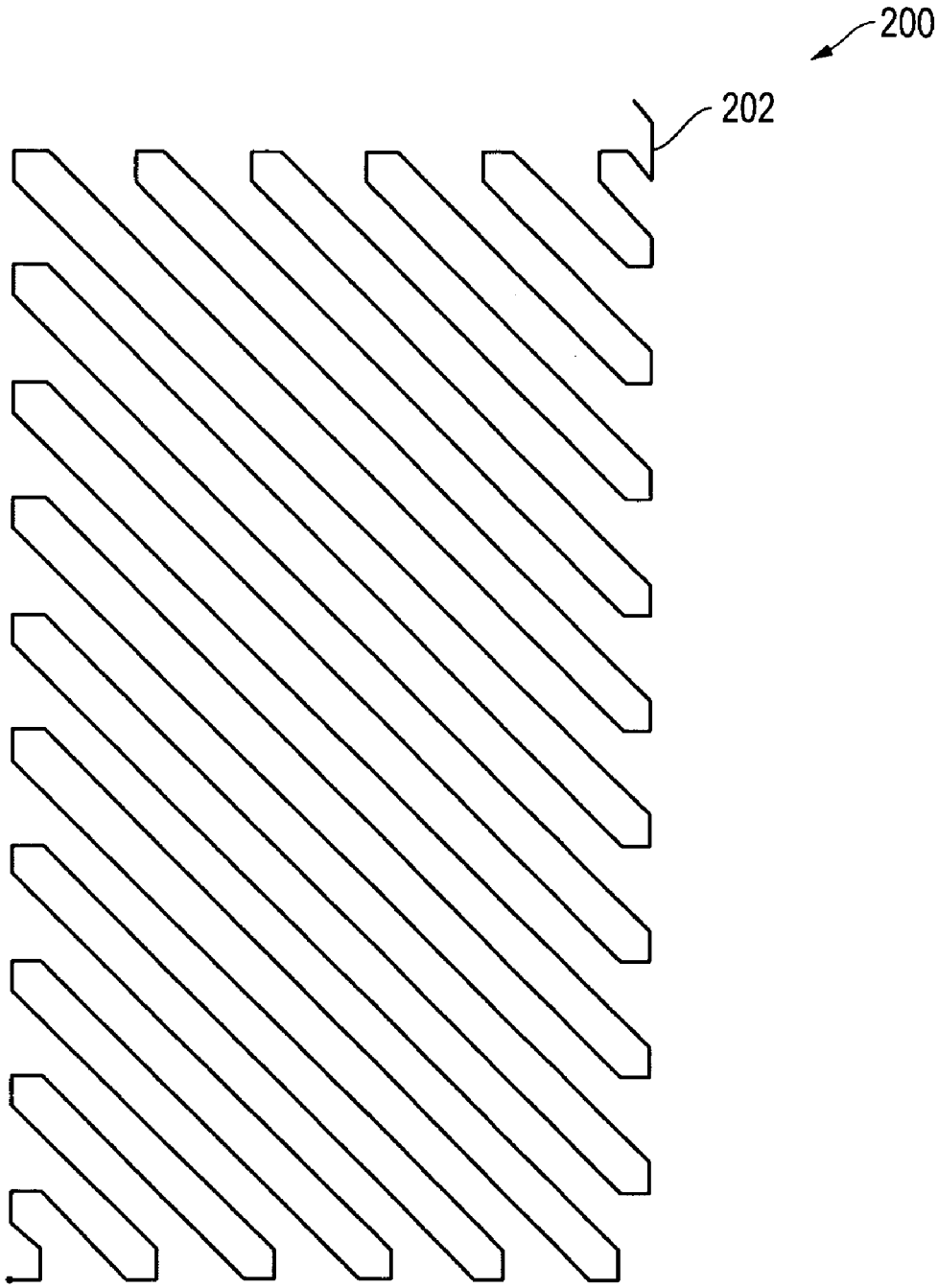
FIG. 2 is a diagram for a folded antenna structure having one directional orientation.

FIG. 2 is a diagram for a folded antenna structure 200 having one directional orientation. As depicted for this alternative embodiment, the antenna conductor 202 has parallel windings primarily oriented in a single direction. This antenna is a spiral shaped wire/trace placed on a PCB or flex circuit. For FM audio broadcast reception, the area of the structure may preferably be configured to vary anywhere from 2 cm×2 cm (about 4 square centimeters) to 5 cm×5 cm (about 25 square centimeters). It is also desirable to maximize the wire/trace length for the dimension chosen, and this length may preferably vary from 50 cm to 150 cm. In addition, the spacing between the wire folds can preferably be configured to be greater than 0.1 cm. Still further, twenty or more folds can be preferably provided within the folded spiral structure. In addition, the capacitance provided by the folded antenna structures can preferably be between 2 pF and 15 pF. Other configurations could also be utilized, if desired. However, folded antenna structures with the above parameters were found to be particularly advantageous for reception and transmission in the FM band (e.g., about 76 to 108 MHz).

Figure 3:
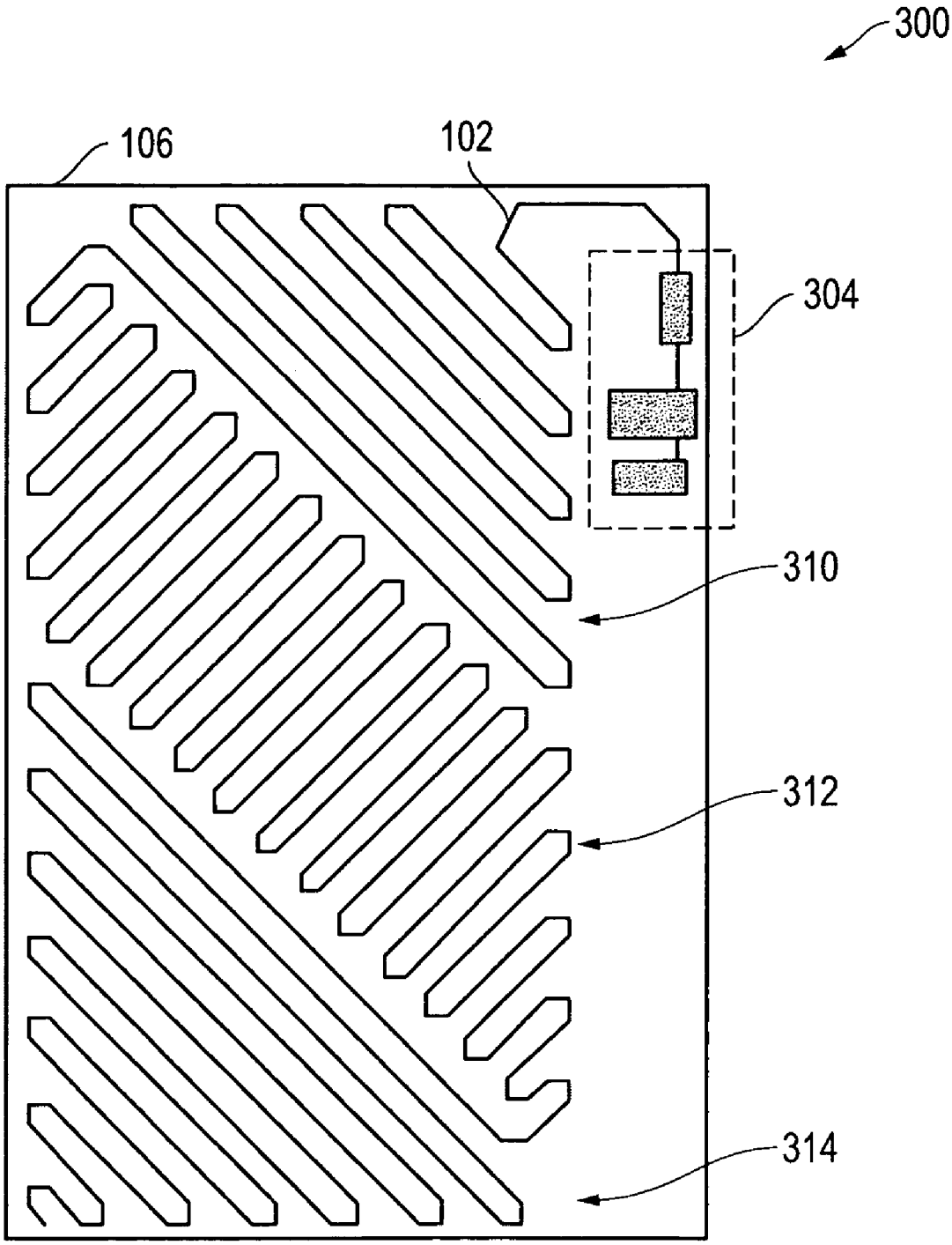
FIG. 3 is a diagram for a folded antenna structure having two directional orientations.

FIG. 3 is a diagram for a folded antenna 300 having two directional orientations. As depicted, the folded antenna 106 includes antenna feed circuitry 304 and antenna conductor 302. The folded antenna structure created by the antenna conductor 302 as it winds and folds across the surface of the folded antenna 106 has three sections. A first section 310 has parallel windings primarily extending along a first direction. The second section 312 has parallel windings primarily extending along a second direction. And the third section 314 has parallel windings primarily extending along the first direction. As such, about ⅔ of the antenna conductor 302 is oriented in the first direction and about ⅓ of the antenna conductor 302 is oriented in a second direction, and these two different directions of orientation are preferably perpendicular with respect to each other. These multiple orientations provide for better reception of incident RF signals that are not always aligned in one direction. In other words, the one or more orientations provides for improved diversity reception for the antenna structure. It is noted that the antenna structure depicted in FIG. 3 forms a folded monopole antenna.

This antenna 300 is spiral shaped but a portion of the antenna folds so that it faces in a different direction. As such the antenna 300 forms a multidirectional spiral. For FM audio broadcast reception, the antenna dimensions, length of wire/trace and spacing can be configured to be within the same limits as the spiral shaped antenna described above. The amount of wire/trace facing in a different direction may vary from one third to one half the total length of wire/trace, as desired.

Figure 4:
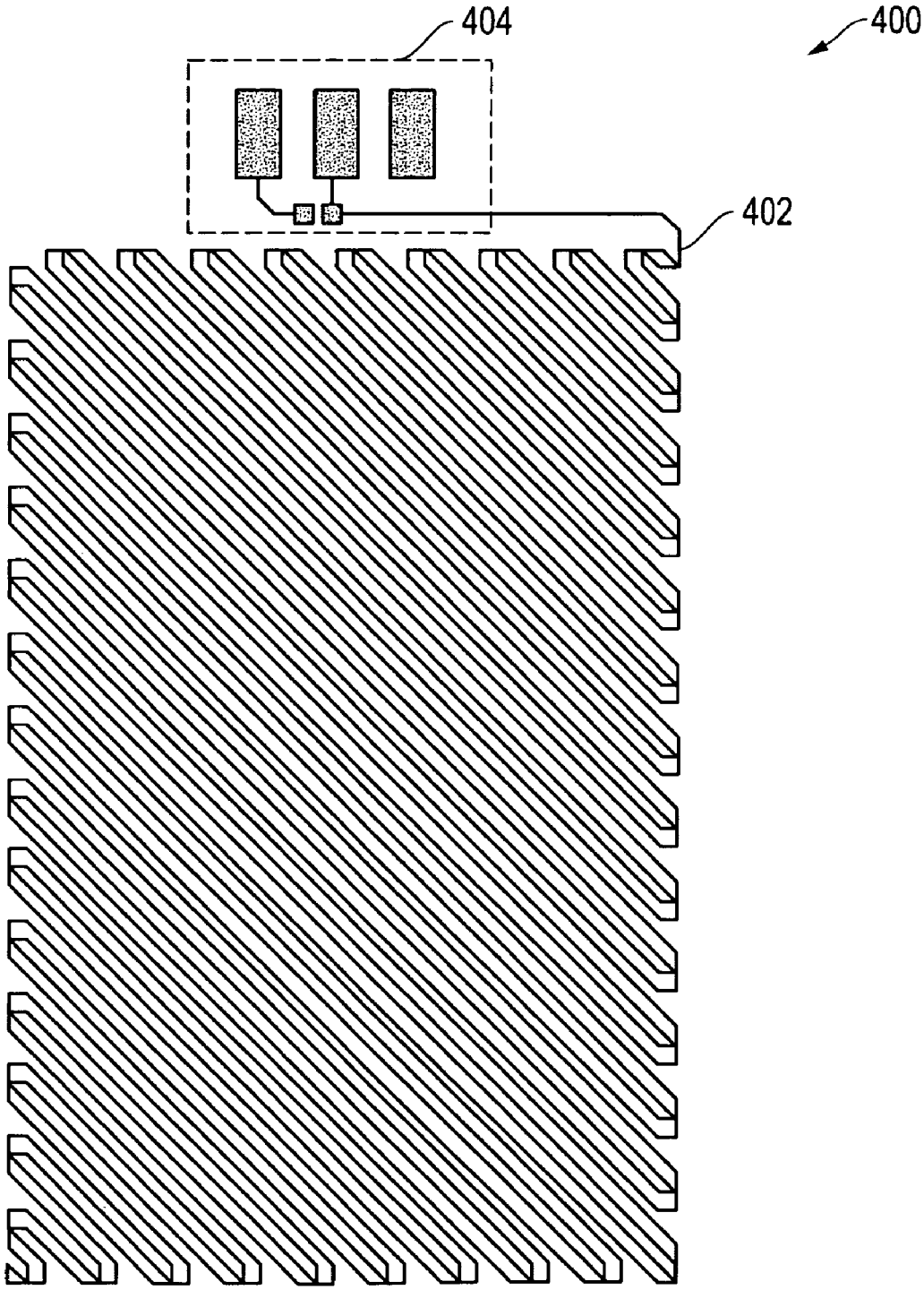
FIG. 4 is a diagram for an overlapping folded antenna structure having one directional orientation.

FIG. 4 is a diagram for an overlapping folded antenna structure 400 having one directional orientation. As depicted for this alternative embodiment, the antenna conductor 402 is split into two overlapping windings or conductor lines that each connect together at the edge of the structure. And both overlapping windings are fed by the antenna feed circuitry 404. These overlapping windings can be formed, for example, by placing one winding on one side of a flex circuit and placing the other winding on the other side of the flex circuit, with a connection between the two being made near the antenna feed circuitry 404. Further, as depicted, both overlapping windings have parallel windings primarily oriented in a single direction. It is also noted that the two windings 402A and 402B can be formed with one meter long conductor lines or wires.

Figure 5B:
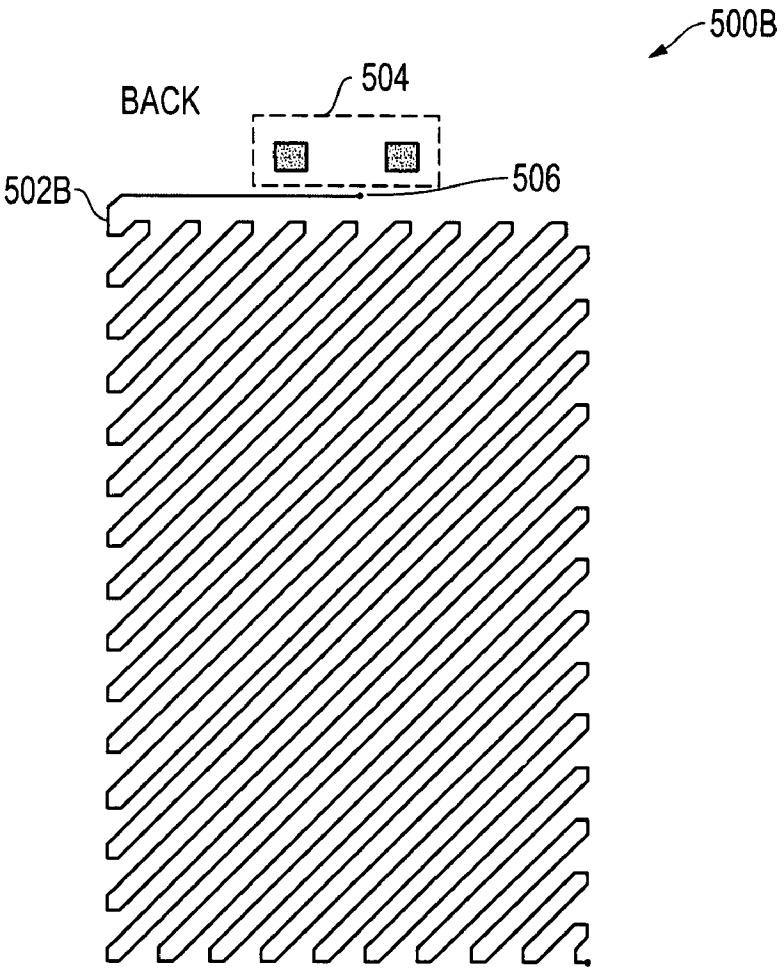
FIGS. 5A and 5B are a diagrams for an overlapping folded antenna structure having two directional orientations.
Figure 5A:
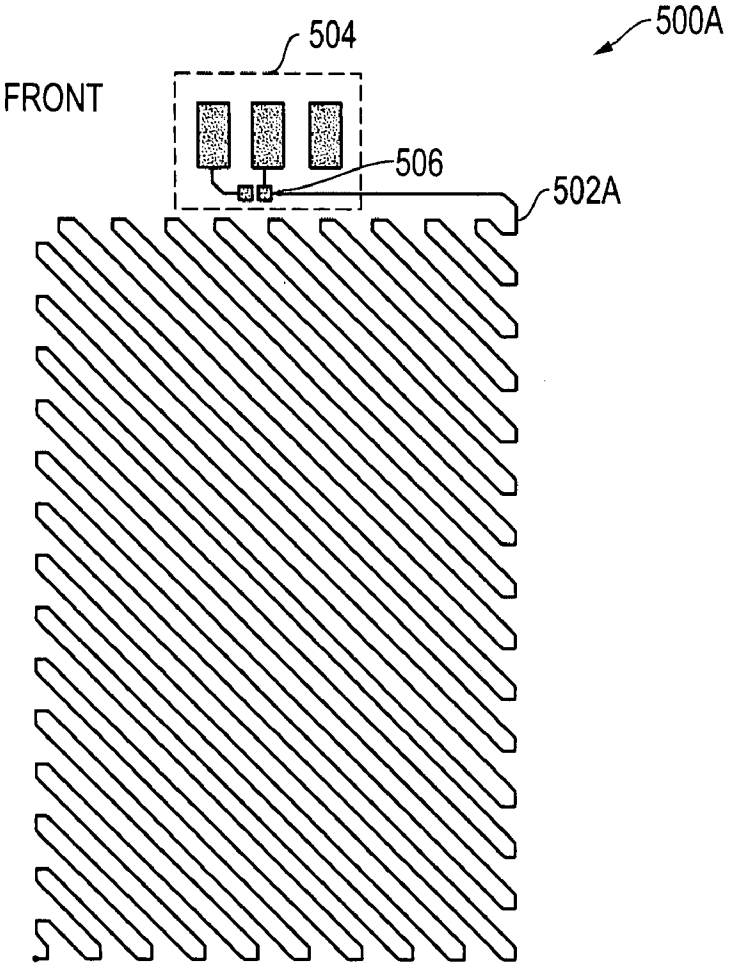

FIGS. 5A and 5B are a diagrams for an overlapping folded antenna structures 500A and 500B having two directional orientations. As depicted for this alternative embodiment, the antenna conductor is split into two overlapping windings 502A and 502B that each connect together at the edge of the structure at connection points 506. And both overlapping windings 502A and 502B are fed by the antenna feed circuitry 504. These overlapping windings can be formed, for example, by placing one winding on one side of a flex circuit and placing the other winding on the other side of the flex circuit. As such, FIG. 5A represents the connection line or windings 502A for a front side (FRONT), and FIG. 5B represents the connection line or windings 502B for a back side (BACK). Further, as depicted, each overlapping windings has a parallel winding primarily oriented in a single direction. However, unlike the embodiment 400 of FIG. 4, winding 502A has a different orientation than winding 502B, and these orientations are preferably perpendicular with respect to each other. It is also noted that the two windings 502A and 502B can be formed with long conductor lines or wires.

Figure 6:
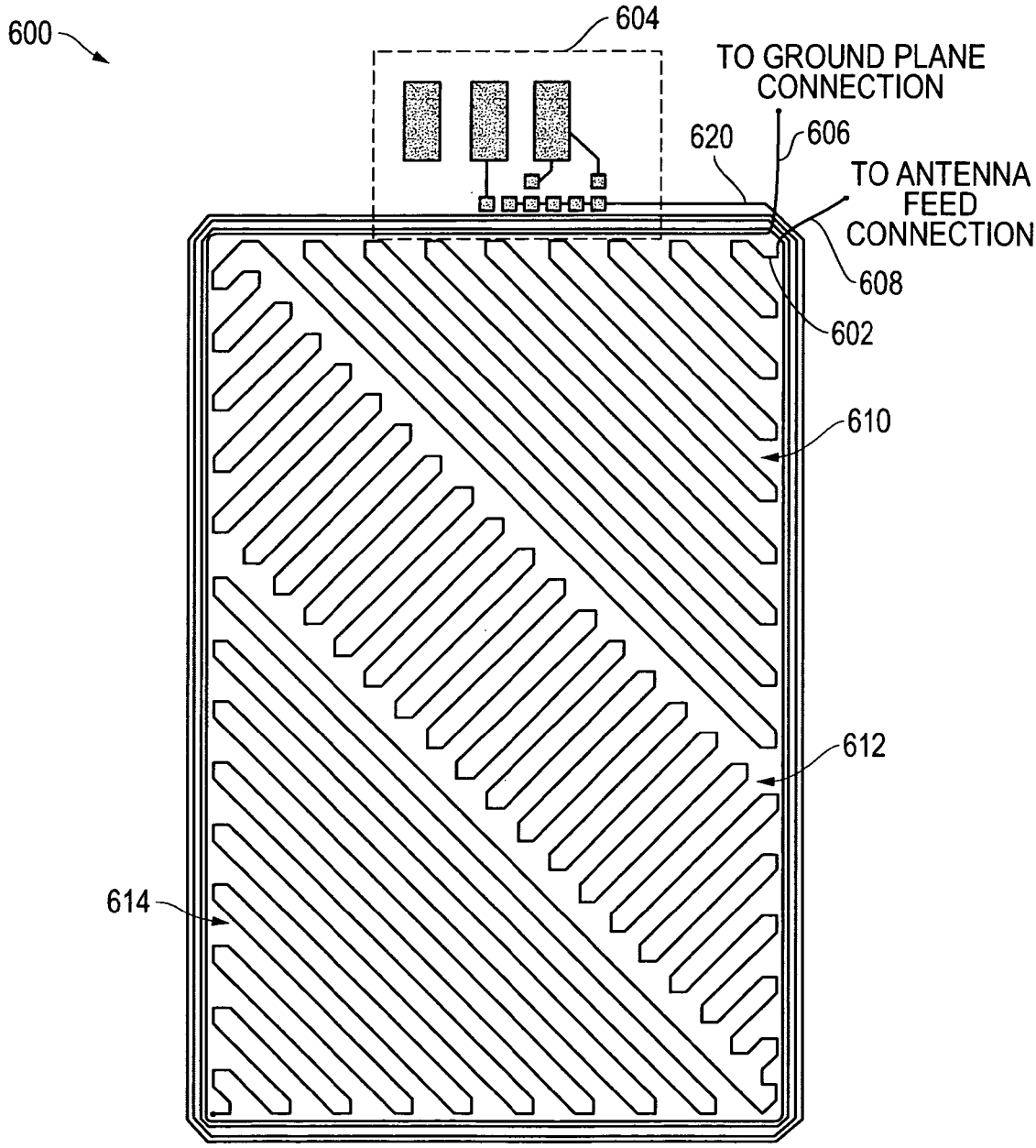
FIG. 6 is a diagram for a folded antenna structure having two directional orientations and a loop antenna surrounding the folded antenna structure.

FIG. 6 is a diagram for a folded antenna structure 600 having two directional orientations and a loop antenna surrounding the folded antenna structure. The antenna conductor 602 is similar to the antenna conductor 202 in FIG. 2. As depicted, the folded antenna structure created by the antenna conductor 602 as it winds and folds across the surface of the folded antenna has three sections. A first section 610 has parallel windings primarily extending along a first direction. The second section 612 has parallel windings primarily extending along a second direction. And the third section 614 has parallel windings primarily extending along the first direction. As such, about ⅔ of the antenna conductor 602 is oriented in the first direction and about ⅓ of the antenna conductor 602 is oriented in a second direction, and these two different directions of orientation are preferably perpendicular with respect to each other. In addition, for the embodiment 600, a second antenna is formed with antenna conductor 620 to form a loop antenna that surrounds the windings of the antenna conductor 602. This loop antenna can include multiple loops (e.g., four loops) that surround the antenna conductor 602. The antenna conductor is coupled to the antenna feed circuitry 604 through connection 608. The loop antenna conductor 620 is also coupled to the antenna feed circuitry 604, and is also coupled at its other end to a ground plane through connection 606.

The spiral shaped antenna and the separate loop antenna as shown in FIG. 6 are connected to the same feed point. The spiral portion of the antenna may or may not be multidirectional, as with FIG. 2 and FIG. 3 above, and can be configured to have the same dimensions, length of wire and spacing as the spiral antennas described above. The loop antenna may be single turn or multi-turn and can be placed along the edge of the PCB shape or the flex circuit enclosing the spiral shape.

The folded antenna structures described herein advantageously form capacitive antenna structures that have reduced interference with the ground plane and with other circuitry within the portable device. As such, the folded antenna structures can be coupled at one end to antenna feed circuitry and can be left uncoupled at their other end. Because the folded antenna structures form highly capacitive antennas, these antennas can advantageously work on a battery cover because the high capacitance dominates the capacitance to ground. It is also noted that the additional loop antenna of FIG. 6 would form an inductive antenna and is, therefore, connected to a ground plane.

With respect to the size of the folded antenna structures herein, it is desirable for FM band (e.g., about 76 to 108 MHz) transmit and receive operations that the antenna conductors be between about 0.8 meters and 1.2 meters and, preferably, be about 1.1 meters. More generally, as indicated above, the antenna conductor lines can preferably be between 0.5 meters and 1.5 meters. In other words, the complete length of the antenna conductor as it winds within the antenna structure is about these total lengths. It is further noted that the size of the antenna structures can be configured, if desired, to fit with a 5.5 cm by 3.6 cm rectangular area or smaller (i.e., about 19.8 square centimeters or less). This size is roughly the size of many common batteries that are used, for example, in portable cellular phones today. However, other larger and/or smaller sizes could also be used, if desired. It has been noted, however, that as the spacing between the parallel windings are made closer and closer, the performance of the antenna drops. As such, there is a practical performance limit to the density of the windings depending upon the overall size of the antenna structure desired. It is further noted that the capacitance formed by an embodiment of FIG. 3 placed within a 5.5 cm by 3.6 cm rectangular structure can be made to have a capacitance to ground of about 2.5 to 5 pica Farads (pF). More generally, as indicated below, the capacitance for the antenna structures described herein can preferably be configured to be between 2 pF and 15 pF.

As indicated above, the folded antenna structures described herein can be implemented on printed circuit boards and/or as relatively flat flex circuits. The manufacture of flex circuits on relatively flat mediums is well known and any desired flex circuit technology that can form that the folded antenna structures described herein could be utilized, as desired.

In operation, a spiral shape antenna with one end point connected to the antenna input of an FM tuner looks capacitive in the FM audio broadcast band. The capacitance of this antenna increases as the total length of the spiral wire is increased. A higher capacitance provides a two fold improvement in the performance of this embedded antenna. First, the antenna can be modeled as a resistor in series with a capacitor. As the capacitance of the antenna increases, its total source impedance in the FM band decreases, thereby providing a higher voltage to a fixed load to which it is connected. This follows from a simple impedance divider network. The series capacitance of the spiral antennas described above will typically vary from about 2 pF to 15 pF depending on the dimensions chosen, the total length of the wire and the spacing between the folds. Second, the higher the capacitance of the antenna, the less impact it has from being placed close to a ground plane because the capacitive effect of the ground plane starts to be negligible. In addition to the capacitance, the spiral antenna folds also have sharp corners, which may form good radiators thereby improving the reception of these folded antenna structures. And the use of multidirectional folds, as described with respect to FIG. 3, helps improve the directional performance of the embedded antenna. Still further, a loop encircling the spiral, as described with respect to FIG. 6, also aids the directional performance of the antenna. One preferred implementation for the folded antenna structures described herein is to attempt to create a maximally capacitive structure by maximizing the length of the radiator (as opposed to just creating a plate of metal which would be more capacitive but otherwise does not work well).

Further modifications and alternative embodiments of this invention will be apparent to those skilled in the art in view of this description. It will be recognized, therefore, that the present invention is not limited by these example arrangements. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the implementations and architectures. For example, equivalent elements may be substituted for those illustrated and described herein, and certain features of the invention may be utilized independently of the use of other features, all as would be apparent to one skilled in the art after having the benefit of this description of the invention.

What is claimed is:

1. An antenna for an electronic device, comprising:

a folded conductor line coupled to a support surface and configured to have at least twenty parallel folds with each fold being at least 0.1 cm from the next fold to form a series of parallel lines connected at alternating ends;

wherein an overall length of the folded conductor line is between 50 centimeters and 150 centimeters;

wherein the folded conductor line lies within a total area of between 4 square centimeters and 25 square centimeters; and wherein the capacitance of the folded conductor line is between 2 pF and 15 pF.

2. The antenna of claim 1, wherein the folded conductor line is configured such that a first portion of the parallel folds are positioned in a different direction from a second portion of the parallel folds to form a multidirectional structure.

3. The antenna of claim 2, wherein a direction for the first portion is perpendicular to the a direction for the second portion.

4. The antenna of claim 3, wherein at least one-third of the total area is used by the first portion.

5. The antenna of claim 1, further comprising a second folded conductor line coupled to the support surface and configured to overlap the folded conductor line, the second folded conductor line further configured to have at least twenty parallel folds with each fold being at least 0.1 cm from the next fold to form a series of parallel lines connected at alternating ends, to have an overall length of between 50 centimeters and 150 centimeters, to lie within a total area of between 4 square centimeters and 25 square centimeters, and to provide a capacitance between 2 pF and 15 pF.

6. The antenna of claim 5, wherein the second folded conductor line is coupled to an opposite surface of the support surface from the folded conductor line.

7. The antenna of claim 5, wherein the second folded conductor line has folds aligned in a same direction as the folds of the folded conductor line.

8. The antenna of claim 5, wherein the second folded conductor line has folds aligned in a different direction from the folds of the folded conductor line.

9. The antenna of claim 1, further comprising a loop conductor line configured to surround the folded conductor line.

10. The antenna of claim 9, wherein the loop conductor line comprises a plurality of loops.

11. The antenna of claim 1, wherein the support surface comprises a printed circuit board.

12. The antenna of claim 1, wherein the support surface comprises a flex circuit.

13. A method for receiving radio frequency signals using a folded antenna structure, comprising:

providing an antenna comprising a folded conductor line coupled to a support surface and configured to have at least twenty parallel folds with each fold being at least 0.1 cm from the next fold to form a series of parallel lines connected at alternating ends, to have an overall length of the folded conductor line of between 50 centimeters and 150 centimeters, to lie within a total area of between 4 square centimeters and 25 square centimeters; and to provide a capacitance between 2 pF and 15 pF;

positioning the antenna within a portable electronic device; and operating the electronic device to receive radio frequency signals using the antenna.

14. The method of claim 13, wherein the folded conductor line is configured such that a first portion of the parallel folds are positioned in a different direction from a second portion of the parallel folds to form a multidirectional structure.

15. The method of claim 13, wherein the positioning step comprises positioning the antenna over a battery for the portable electronic device.

16. The method of claim 15, wherein the positioning step comprises coupling the antenna to a battery cover for the portable electronic device.

17. A method for transmitting radio frequency signals in an electronic device using a folded antenna structure, comprising:

providing an antenna comprising a folded conductor line coupled to a support surface and configured to have at least twenty parallel folds with each fold being at least 0.1 cm from the next fold to form a series of parallel lines connected at alternating ends, to have an overall length of the folded conductor line of between 50 centimeters and 150 centimeters, to lie within a total area of between 4 square centimeters and 25 square centimeters, and to provide a capacitance between 2 pF and 15 pF;

positioning the antenna within a portable electronic device; and operating the electronic device to transmit radio frequency signals using the antenna.

18. The method of claim 17, wherein the folded conductor line is configured such that a first portion of the parallel folds are positioned in a different direction from a second portion of the parallel folds to form a multidirectional structure.

19. The method of claim 17, wherein the positioning step positioning the antenna over a battery for the portable electronic device.

20. The method of claim 19, wherein the positioning step comprises coupling the antenna to a battery cover for the portable electronic device.

* * * * *